US009223232B2

(12) United States Patent
Sugiyama et al.

(10) Patent No.: US 9,223,232 B2
(45) Date of Patent: Dec. 29, 2015

(54) METHOD FOR PRODUCING ELECTROPHOTOGRAPHIC PHOTOSENSITIVE MEMBER

(71) Applicant: CANON KABUSHIKI KAISHA, Tokyo (JP)

(72) Inventors: Kazumichi Sugiyama, Numazu (JP); Daisuke Tanaka, Yokohama (JP); Kazunori Noguchi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 49 days.

(21) Appl. No.: 14/162,584

(22) Filed: Jan. 23, 2014

(65) Prior Publication Data

US 2014/0212806 A1 Jul. 31, 2014

(30) Foreign Application Priority Data

Jan. 25, 2013 (JP) ..... 2013-011763
Dec. 10, 2013 (JP) ..... 2013-255198

(51) Int. Cl.
*G03G 5/14* (2006.01)
*G03G 5/05* (2006.01)

(52) U.S. Cl.
CPC ..... *G03G 5/0525* (2013.01); *G03G 5/142* (2013.01); *G03G 5/144* (2013.01)

(58) Field of Classification Search
CPC ..... G03G 5/0525; G03G 5/14; G03G 5/142; G03G 5/144
See application file for complete search history.

(56) References Cited

U.S. PATENT DOCUMENTS

2006/0009576 A1* 1/2006 Molaire ..... 524/839
2007/0049676 A1 3/2007 Wu
2012/0322998 A1* 12/2012 Hongo et al. ..... 540/141

FOREIGN PATENT DOCUMENTS

EP 2600195 A1 6/2013
JP 2004-198734 A 7/2004
JP 2006-030700 A 2/2006
WO 2012/014909 A1 2/2012

* cited by examiner

*Primary Examiner* — Peter Vajda
(74) *Attorney, Agent, or Firm* — Canon U.S.A. Inc., IP Division

(57) ABSTRACT

A method for producing an electrophotographic photosensitive member including an undercoat layer includes preparing a coating liquid for an undercoat layer containing zinc oxide particles, a polyol, a blocked isocyanate compound whose isocyanate group is blocked with a specific structure, and a solvent mixture, in which the solvent mixture contains a monohydric alcohol in an amount of 1 chemical equivalent or more based on the specific structure and 90% by mass or less based on the total mass of the solvent mixture, and a ketonic solvent and/or a cyclic ether solvent in an amount of 7% by mass or more based on the total mass of the solvent mixture.

10 Claims, 2 Drawing Sheets

METHOD FOR PRODUCING ELECTROPHOTOGRAPHIC PHOTOSENSITIVE MEMBER

BACKGROUND OF THE INVENTION

1. Field of the Invention

Embodiments of the present invention relate to a method for producing an electrophotographic photosensitive member.

2. Description of the Related Art

An electrophotographic photosensitive member including an undercoat layer and a photosensitive layer stacked, in that order, on a support has often been used as an electrophotographic photosensitive member used in an electrophotographic apparatus. As the photosensitive layer, a function separation type (laminated) photosensitive layer having a functionally separated structure that includes a charge generation layer containing a charge generation material and a charge transport layer (for example, a hole transport layer) containing a charge transport material (for example, a hole transport material) has often been used.

The undercoat layer is disposed in order to, for example, suppress charge injection, e.g., hole injection, from the support to the photosensitive layer. The undercoat layer having the function of blocking charge injection inhibits the occurrence of an image failure (a black spot).

For example, metal oxide particles are often incorporated into the undercoat layer in order to inhibit the accumulation of charges, e.g., electrons, in the undercoat layer. The inhibition of charge accumulation in the undercoat layer results in the inhibition of variations in light area potential due to the repeated use of the electrophotographic photosensitive member.

In particular, zinc oxide particles may be used as the metal oxide particles for use in the undercoat layer from the viewpoint of achieving good electrical properties, such as volume resistivity and a dielectric constant. Japanese Patent Laid-Open No. 2006-30700 discloses a technique for incorporating zinc oxide particles into an undercoat layer of an electrophotographic photosensitive member.

Each of the layers of the electrophotographic photosensitive member is commonly formed by forming a coating film of a coating liquid for the corresponding layer and drying and/or curing the coating film, the coating liquid being prepared by mixing a charge generation material, a charge transport material, metal oxide particles, or the like with a solvent together with a binding resin.

Thus, the binding resin used for the undercoat layer is required to have resistance to a solvent (solvent resistance, i.e., insolubility) contained in a coating liquid (a photosensitive layer coating liquid (a charge generation layer coating liquid or a charge transport layer coating liquid) or the like)) applied on or above the undercoat layer. The undercoat layer is required to have endurance in the repeated use of the electrophotographic photosensitive member and resistance to various environments, such as a high-temperature and high-humidity environment and a low-temperature and low-humidity environment. A curable resin may be used as the binding resin used for the undercoat layer from these points of view. In the case where the curable resin is used as the binding resin for the undercoat layer, the curable resin is required to be curable at a low temperature (to form a cured resin at a low temperature) from the viewpoint of achieving good productivity of the electrophotographic photosensitive member.

With respect to a resin that meets the requirement, there is a technique in which a resin curable at a low temperature is used as an undercoat layer. Japanese Patent Laid-Open No. 2004-198734 discloses a technique in which a curable resin (a urethane resin) prepared by allowing a blocked isocyanate having an isocyanate group blocked with a diethyl malonate structure to react with a polyol resin is used as a binding resin for an undercoat layer. Regarding an isocyanate compound, an isocyanate group may be blocked with a blocking agent in order to control the reactivity. An isocyanate compound with a blocked isocyanate group is referred to as a "blocked isocyanate compound".

The results of studies by the inventors, however, revealed the following problems: That is, a coating liquid containing a polyol resin and a blocked isocyanate whose isocyanate group is blocked with a structure, such as a diethyl malonate structure, represented by the formula (1) increases in viscosity with time, in some cases. The reason for this is presumably that these materials are easily subjected to a curing reaction and thus the curing reaction proceeds gradually even in a normal temperature environment, (1)

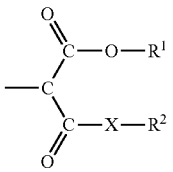

wherein, in the formula (1), X represents a single bond or an oxygen atom, and $R^1$ and $R^2$ each independently represent an alkyl group having 1 to 4 carbon atoms. In the case where in the formula (1), X represents an oxygen atom and where each of $R^1$ and $R^2$ represents an ethyl group, the formula (1) represents a diethyl malonate structure.

An increase in the viscosity of the coating liquid for an undercoat layer reduces the uniformity of a coat of the coating liquid for an undercoat layer. This is liable to cause a reduction in the properties of an undercoat layer. Furthermore, this affects the uniformity of a photosensitive layer, such as a charge generation layer or a charge transport layer, disposed on an undercoat layer and thus may be a contributing factor to the occurrence of an image failure. The thickness of a layer is adjusted by adjusting the viscosity of a coating liquid. It is thus important to inhibit variations in the viscosity of the coating liquid for an undercoat layer from the viewpoint of achieving mass production of electrophotographic photosensitive members with undercoat layers having the same thickness.

The inventors have conducted intensive studies and have found that the use of a solvent as described below inhibits the increase in the viscosity of a coating liquid for an undercoat layer with time. That is, a monohydric alcohol is used as a solvent used in a coating liquid for an undercoat layer, the coating liquid containing a polyol and a blocked isocyanate compound whose isocyanate group is blocked with the structure represented by the formula (1).

However, it was found that the simple use of the monohydric alcohol as a solvent used in the coating liquid for an undercoat layer for the purpose of stabilizing the viscosity of the coating liquid for an undercoat layer causes a black spot to form in an output image. The reason for this is presumably that the use of the monohydric alcohol as a solvent used in the coating liquid for an undercoat layer reduces the dispersibility of zinc oxide particles in the coating liquid for an undercoat layer.

To allow an undercoat layer to sufficiently provide the function of blocking charge injection, it is important that the undercoat layer should have a high uniformity of distribution of zinc oxide particles (in other words, the degree of aggregation of the zinc oxide particles be low). The reason for this is that a higher degree of aggregation of the zinc oxide particles in the undercoat layer is liable to lead to a larger number of conductive paths in the undercoat layer and that a larger number of the conductive paths in the undercoat layer is liable to cause the undercoat layer to have a reduced function of blocking charge injection.

To increase the uniformity of distribution of the zinc oxide particles in the undercoat layer, it is important that the coating liquid for an undercoat layer should have a highly uniform distribution of the zinc oxide particles.

SUMMARY OF THE INVENTION

One disclosed aspect of the invention provides a method for producing an electrophotographic photosensitive member by the use of a coating liquid for an undercoat layer which can be cured at a low temperature, which is less likely to cause an increase in viscosity with time, and which has the high dispersion stability of zinc oxide particles.

A method for producing an electrophotographic photosensitive member including a support, an undercoat layer formed on the support, and a photosensitive layer formed on the undercoat layer includes:

preparing a coating liquid for an undercoat layer containing zinc oxide particles, a polyol, a blocked isocyanate compound whose isocyanate group is blocked with a structure represented by the following formula (1), and a solvent mixture, forming a coat of the coating liquid for an undercoat layer, and drying and curing the coat to form the undercoat layer, (1)

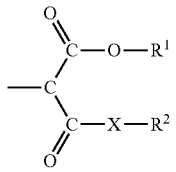

wherein, in the formula (1), X represents a single bond or an oxygen atom, $R^1$ and $R^2$ each independently represent an alkyl group having 1 to 4 carbon atoms, and in which the solvent mixture contains:

a monohydric alcohol in an amount of 1 chemical equivalent or more based on the structure represented by the formula (1), and 90% by mass or less based on the total mass of the solvent mixture, and a ketonic solvent and/or a cyclic ether solvent in an amount of 7% by mass or more based on the total mass of the solvent mixture.

Further features of the present invention will become apparent from the following description of exemplary embodiments with reference to the attached drawings.

DESCRIPTION OF THE EMBODIMENTS

Figure 1A:
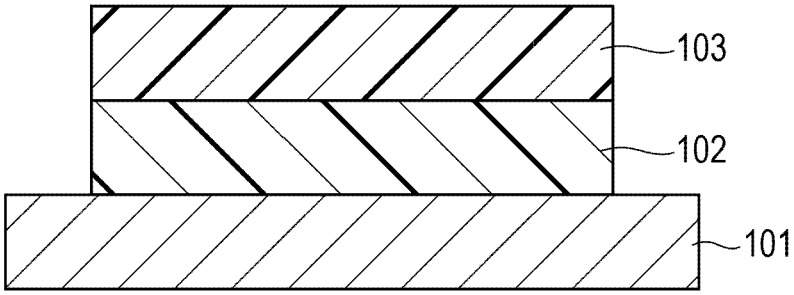
FIGS. 1A and 1B are exemplary layer structures of electrophotographic photosensitive members produced by a production method according to an embodiment of the present invention.

A method for producing an electrophotographic photosensitive member according to an embodiment of the present invention, the electrophotographic photosensitive member including a support, an undercoat layer formed on the support, and a photosensitive layer formed on the undercoat layer, includes preparing a coating liquid for an undercoat layer, the coating liquid containing zinc oxide particles, a polyol, a blocked isocyanate compound whose isocyanate group is blocked with a structure represented by the following formula (1), and a solvent mixture, (1)

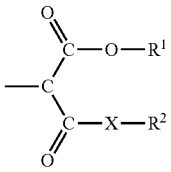

wherein, in the formula (1), X represents a single bond or an oxygen atom, $R^1$ and $R^2$ each independently represent an alkyl group having 1 to 4 carbon atoms, and in which the solvent mixture contains a monohydric alcohol in an amount of 1 chemical equivalent or more based on the structure represented by the formula (1) and 90% by mass or less based on the total mass of the solvent mixture, and a ketonic solvent and/or a cyclic ether solvent in an amount of 7% by mass or more based on the total mass of the solvent mixture.

Examples of the alkyl groups, denoted as $R^1$ and $R^2$ in the formula (1), each having 1 to 4 carbon atoms include a methyl group, an ethyl group, a propyl group (a n-propyl group or an isopropyl group), and a butyl group (a n-butyl group, an isobutyl group, or tert-butyl group). Among these groups, a methyl group and an ethyl group may be used. In the case where X in the formula (1) represents a single bond, C to the left of X is directly bonded to $R^2$ to the right of X in the formula (1).

Ketone has a structure (—C(C═O)C—) in which a carbon atom of a carbonyl group is located between two carbon atoms and bonded thereto. Examples of the ketonic solvent (ketone-based solvent) include acetone, methyl ethyl ketone, cyclohexanone, heptanone, methyl isobutyl ketone, and isophorone. Among these compounds, acetone, methyl ethyl ketone, and cyclohexanone may be used.

Cyclic ether has a cyclic structure (—COC—) in which an oxygen atom is located between two carbon atoms and bonded thereto. Examples of the cyclic ether solvent (cyclic ether-based solvent) include tetrahydrofuran and tetrahydropyran. Among these compounds, tetrahydrofuran may be used.

Examples of the monohydric alcohol include methanol, ethanol, propanol, such as 1-propanol, butanol, such as 1-butanol, methoxypropanol, such as 1-methoxy-2-propanol, cyclohexanol, and benzyl alcohol. Among these compounds, ethanol, propanol, butanol, methoxypropanol, and cyclohexanol may be used.

The inventors speculate that the reason the solvent mixture having the foregoing composition and being contained in the coating liquid for an undercoat layer provides advantages of the present invention are as follows: The advantages of the present invention are to achieve both the inhibition of the increase in the viscosity of the coating liquid for an undercoat layer with time and the high dispersion stability of the zinc oxide particles in the coating liquid for an undercoat layer (resistance to an increase in the particle size of the zinc oxide particles).

As described above, the increase in the viscosity of the coating liquid for an undercoat layer with time is probably attributed to the fact that the curing reaction between the blocked isocyanate compound and the polyol proceeds easily. Here, the incorporation of the monohydric alcohol into the coating liquid for an undercoat layer causes a substitution reaction between the ester bond of the structure of the blocked isocyanate compound represented by the formula (1) and the monohydric alcohol to occur, thereby changing the equilibrium state of the curing reaction between the blocked isocyanate compound and the polyol. As a result, the curing reaction between the blocked isocyanate compound and the polyol is less likely to proceed. In particular, the incorporation of the monohydric alcohol into the coating liquid for an undercoat layer in an amount of 1 chemical equivalent or more based on the structure represented by the formula (1) inhibits the increase in the viscosity of the coating liquid for an undercoat layer with time.

Meanwhile, in order to achieve high dispersion stability of the zinc oxide particles in the coating liquid for an undercoat layer, the absolute value of the zeta potential of the zinc oxide particles in the coating liquid for an undercoat layer is seemingly required to be large to some extent. The zeta potential of the zinc oxide particles in the coating liquid for an undercoat layer may be adjusted by the choice of the type of solvent contained in the coating liquid for an undercoat layer and the adjustment of the amount of the solvent.

The inventors have conducted intensive studies and have found that in the case where the coating liquid for an undercoat layer contains the monohydric alcohol in an amount of 1 chemical equivalent or more and has a monohydric alcohol content of 90% by mass or less based on the total mass of the solvent mixture in the coating liquid for an undercoat layer and contains a solvent composed of one or both of a ketone-based solvent and a cyclic ether-based solvent in an amount of 7% by mass or more based on the total mass of the solvent mixture, the dispersion stability of the zinc oxide particles in the coating liquid for an undercoat layer is increased. In particular, the solvent mixture may contain the monohydric alcohol in an amount of 50% by mass or less based on the total mass of the solvent mixture.

The zinc oxide particles contained in the coating liquid for an undercoat layer may be treated (surface-treated) with a surface treatment agent, such as a silane coupling agent, in advance from the viewpoint of inhibiting the occurrence of an image failure (a black spot) due to charge injection (e.g., hole injection) from the support into the photosensitive layer.

Examples of the silane coupling agent used to surface-treat the zinc oxide particles include N-2-(aminoethyl)-3-aminopropylmethyldimethoxysilane, 3-aminopropylmethyldiethoxysilane, (phenylaminomethyl)methyldimethoxysilane, N-2-(aminoethyl)-3-aminoisobutylmethyldimethoxysilane, N-ethylaminoisobutylmethyldiethoxysilane, N-methylaminopropylmethyldimethoxysilane, vinyltrimethoxysilane, 3-aminopropyltriethoxysilane, N-(2-aminoethyl)-3-aminopropyltrimethoxysilane, methyltrimethoxysilane, 3-glycidoxypropyltrimethoxysilane, 3-methacryloxypropyltrimethoxysilane, 3-chloropropyltrimethoxysilane, and 3-mercaptopropyltrimethoxysilane.

The coating liquid for an undercoat layer used in an embodiment of the present invention contains the zinc oxide particles, the polyol, and the blocked isocyanate compound whose isocyanate group is blocked with the structure represented by the formula (1) as described above. A urethane resin, which is a curable resin, is formed by the curing reaction between the polyol and the blocked isocyanate compound.

Examples of an isocyanate compound that may be blocked include 2,4-tolylene diisocyanate, 2,6-tolylene diisocyanate, diphenylmethane-4,4'-diisocyanate, 1-isocyanato-3,3,5-trimethyl-5-isocyanatomethylcyclohexane (isophorone diisocyanate, IPDI), hexamethylene diisocyanate (HDI), an HDI-trimethylolpropane adduct, HDI-isocyanurate, and HDI-biuret. Among these compounds, aliphatic diisocyanates, such as hexamethylene diisocyanate and isophorone diisocyanate, may be used from the viewpoint of increasing the crosslinking density of the urethane resin and inhibiting the adsorption of water on the zinc oxide particles. Furthermore, a compound having a central skeleton composed of isocyanurate may be used. These isocyanate compounds may be used separately or in combination of two or more.

The blocked isocyanate compound whose isocyanate group is blocked with the structure represented by the formula (1) is prepared by allowing the isocyanate group of the isocyanate compound to react with a compound having a structure represented by the formula (1).

Examples of the compound having a structure represented by the formula (1) include dialkyl malonate and acetoacetic ester. Examples of dialkyl malonate include dimethyl malonate, diethyl malonate, diisopropyl malonate, di-n-propyl malonate, di-n-butyl malonate, di-tert-butyl malonate, and tert-butylethyl malonate. Examples of acetoacetic ester include methyl acetoacetate, ethyl acetoacetate, isopropyl acetoacetate, n-propyl acetoacetate, and tert-butyl acetoacetate.

Examples of the polyol include polyvinyl acetal, polyphenol, polyethylene diol, polycarbonate diol, polyether polyol, and polyacrylic polyol. Among these compounds, polyvinyl acetal may be used. These polyols may be used separately or in combination of two or more.

The ratio (Mm/Mu) of the mass (Mm) of the zinc oxide particles to the total mass (Mu) of the blocked isocyanate compound and the polyol in the coating liquid for an undercoat layer may be 1/1 or more (mass ratio). A ratio of 1/1 or more (mass ratio) results in improvement of electrical properties (the inhibition of variations in light area potential when the resulting electrophotographic photosensitive member is repeatedly used) and thus is preferred. A ratio of 2/1 or more (mass ratio) is more preferred. Furthermore, the ratio (Mm/Mu) may be 4/1 or less (mass ratio) from the viewpoint of inhibiting the occurrence of cracking of the undercoat layer. Thus, the ratio (Mm/Mu) may be 2/1 or more and 4/1 or less (mass ratio).

The coating liquid for an undercoat layer may further contain organic resin particles, a leveling agent, or the like from the viewpoints of adjusting the surface roughness of the undercoat layer and inhibiting the occurrence of cracking of the undercoat layer.

Examples of the organic resin particles include hydrophobic organic resin particles, such as silicone particles, and hydrophilic organic resin particles, such as polymethyl methacrylate (PMMA) particles.

The coating liquid for an undercoat layer may further contain various additives in order to improve the electrical properties of the undercoat layer, the shape stability of the layer, image quality, and so forth.

Examples of the additives include metal particles, such as aluminum particles and copper particles; conductive particles, such as carbon black; electron transport substances, such as quinone compounds, fluorenone compounds, oxadiazole-based compounds, diphenoquinone compounds, alizarin compounds, benzophenone compounds, polycyclic compounds, and azo compounds; metal chelate compounds; and silane coupling agents.

The drying temperature (heating temperature) of a coat of the coating liquid for an undercoat layer is preferably 100° C. or higher and 190° C. or lower. In the case where the drying temperature is within the above range, the cracking of the undercoat layer is inhibited, and the curing reaction between the blocked isocyanate compound and the polyol proceeds readily. The drying temperature is more preferably 130° C. or higher and 155° C. or lower. The drying time (heating time) of the coat of the coating liquid for an undercoat layer is preferably 10 minutes or more and 120 minutes or less and more preferably 10 minutes or more and 60 minutes or less.

An electrophotographic photosensitive member produced by the production method according to an embodiment of the present invention (hereinafter, also referred to as an "electrophotographic photosensitive member according to an embodiment of the present invention") includes a support, an undercoat layer formed on the support, and a photosensitive layer formed on the undercoat layer. The electrophotographic photosensitive member may include a laminated photosensitive layer serving as the photosensitive layer, the laminated photosensitive layer including a charge generation layer disposed on the undercoat layer and a charge transport layer disposed on the charge generation layer.

Figure 1B:
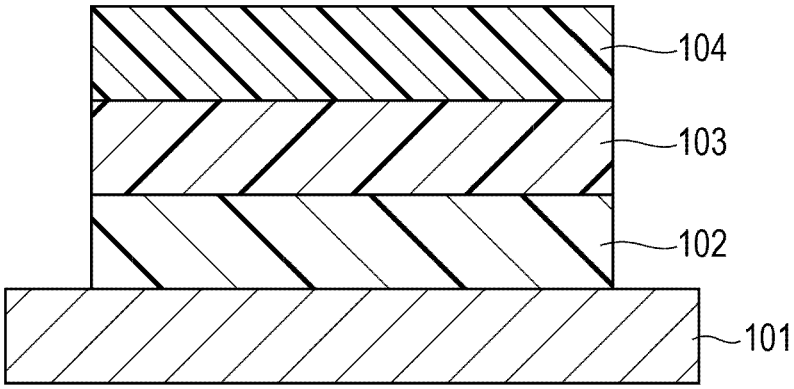

FIG. 1 illustrates an example of the layer structure of an electrophotographic photosensitive member produced by the production method according to an embodiment of the present invention. In FIG. 1, reference numeral 101 denotes a support. Reference numeral 102 denotes an undercoat layer. Reference numeral 103 denotes a photosensitive layer. Reference numeral 104 denotes a protective layer.

As the photosensitive layer, a laminated photosensitive layer including a charge generation layer containing a charge generation material and a charge transport layer containing a charge transport material stacked, in that order, from the undercoat layer side may be used. As the charge transport material contained in the charge transport layer, a hole transport material may be used.

The support may be a conductive support. Examples of the support include supports composed of metals and alloys, such as aluminum, aluminum alloys, stainless steel, copper, nickel, and zinc. In the case where a support composed of aluminum or an aluminum alloy is used, an ED tube or an EI tube may be used.

In addition, a component in which a thin film composed of a conductive material, e.g., aluminum, an aluminum alloy, or an indium oxide-tin oxide alloy, is disposed on a metal support or a resin support may be used as a support.

A surface of the support may be subjected to cutting treatment, roughening treatment, anodizing treatment, electrolytic composite polishing treatment, wet honing treatment, or dry honing treatment for the purpose of inhibiting the occurrence of interference fringes due to laser light scattering. The electrolytic composite polishing refers to polishing by employing electrolysis with an electrode having electrolytic action and an electrolytic solution and a whetstone having polishing action.

A conductive layer may be disposed between the support and the undercoat layer for the purpose of inhibiting the occurrence of interference fringes due to laser light scattering and concealing (covering) a scratch on the support.

The conductive layer may be formed by applying a conductive layer coating liquid and drying and/or curing the resulting coat, the conductive layer coating liquid being prepared by performing dispersion treatment of conductive particles, for example, carbon black, metal particles, or metal oxide particles, a binding resin, and a solvent.

Examples of the binding resin used for the conductive layer include polyester, polycarbonate, polyvinyl butyral, acrylic resins, silicone resins, epoxy resins, melamine resins, urethane resins, phenolic resins, and alkyd resins.

Examples of the solvent used for the conductive layer coating liquid include ether-based solvents, alcohol-based solvents, ketone-based solvents, and aromatic hydrocarbon-based solvents. These solvents may be used separately or in combination of two or more.

The conductive layer preferably has a thickness of 5 μm or more and 40 μm or less and more preferably 10 μm or more and 30 μm or less.

The undercoat layer is disposed between the support or the conductive layer and the photosensitive layer (the charge generation layer and the charge transport layer).

In an embodiment of the present invention, the undercoat layer is formed by the use of the coating liquid for an undercoat layer, the coating liquid being prepared from the zinc oxide particles, the polyol, the blocked isocyanate compound, and the solvent mixture, as described above.

The coating liquid for an undercoat layer may be prepared by, for example, the dispersion treatment of the zinc oxide particles, the polyol, the blocked isocyanate compound, and the solvent mixture.

Examples of the dispersion treatment include methods with dispersion treatment devices, such as paint shakers, ball mills, sand mills, and roll mills. Examples of dispersion media used for the dispersion treatment devices include spherical beads composed of glass, alumina, and zirconia. These beads may have a particle size (diameter) of 0.3 mm or more and 1.0 mm or less.

The undercoat layer preferably has a thickness of 0.5 μm or more and 40 μm or less and more preferably 0.5 μm or more and 10 μm or less from the viewpoint of inhibiting variations in light area potential due to the repeated use of the electrophotographic photosensitive member.

In the case where the conductive layer is not disposed, the undercoat layer preferably has a thickness of 10 μm or more and 40 μm or less and more preferably 15 μm or more and 35 μm or less from the viewpoint of concealing (covering) a scratch on the support.

The photosensitive layer (the charge generation layer and the charge transport layer) is disposed on the undercoat layer.

In the case where the photosensitive layer is a laminated photosensitive layer, the charge generation layer may be formed by applying a charge generation layer coating liquid and drying the resulting coat, the charge generation layer coating liquid being prepared by the dispersion treatment of the charge generation material, a binding resin, and a solvent. The charge generation layer may be formed by the deposition of the charge generation material.

Examples of a method of the dispersion treatment include methods with homogenizers, ultrasonic dispersers, ball mills, sand mills, roll mills, vibration mills, attritors, and liquid-collision type high-speed dispersers.

Examples of the charge generation material include azo pigments, phthalocyanine pigments, indigo pigments, perylene pigments, polycyclic quinone pigments, squarylium dyes, thiapyrylium salts, triphenylmethane dyes, quinacridone pigments, azulenium salt pigments, cyanine dyes, anthanthrone pigments, pyranthrone pigments, xanthene dyes, quinonimine dyes, and styryl dyes. Among these materials, titanyl phthalocyanine, chlorogallium phthalocyanine, and hydroxygallium phthalocyanine may be used from the viewpoint of achieving good sensitivity. Among these compounds, hydroxygallium phthalocyanine may be used. In particular, hydroxygallium phthalocyanine crystals of a crystal form that exhibits strong peaks at 7.4°±0.3° and 28.2°±0.3° of Bragg angles (2θ) in X-ray diffraction with CuKα characteristic radiation may be used. These charge generation materials may be used separately or in combination of two or more.

In the case where the photosensitive layer is a laminated photosensitive layer, examples of the binding resin used for the charge generation layer include polycarbonate, polyester, butyral resins, polyvinyl acetal, acrylic resins, vinyl acetate resins, and urea resins. Among these materials, butyral resins may be used. These binding resins may be used separately or in combination of two or more.

Examples of the solvent used for the charge generation layer coating liquid include alcohol-based solvents, sulfoxide-based solvents, ketone-based solvents, ether-based solvents, ester-based solvents, and aromatic hydrocarbon-based solvents. These solvents may be used separately or in combination of two or more.

The charge generation layer preferably has a thickness of 0.01 μm or more and 5 μm or less and more preferably 0.1 μm or more and 2 μm or less.

The charge generation layer may further contain various additives, such as sensitizers, antioxidants, ultraviolet absorbing agents, and plasticizers, as needed.

In the electrophotographic photosensitive member including the laminated photosensitive layer, the charge transport layer is disposed on the charge generation layer.

The charge transport layer may be formed by applying a charge transport layer coating liquid and drying the resulting coat, the charge transport layer coating liquid being prepared by dissolving a charge transport material and a binding resin in a solvent.

Charge transport materials are broadly classified into hole transport materials and electron transport materials. Examples of the hole transport materials include triarylamine compounds, hydrazone compounds, styryl compounds, stilbene compounds, and butadiene compounds. Among these compounds, triarylamine compounds may be used. These charge transport materials may be used separately or in combination of two or more.

In the case where the photosensitive layer is a laminated photosensitive layer, examples of the binding resin used for the charge transport layer include acrylic resins, acrylonitrile resins, allyl resins, alkyd resins, epoxy resins, silicone resins, phenolic resins, phenoxy resins, polyacrylamide, polyamide-imide, polyamide, polyallyl ether, polyarylate, polyimide, urethane resins, polyester, polyethylene, polycarbonate, polysulfone, polyphenylene oxide, polybutadiene, polypropylene, and methacrylic resins. Among these compounds, polyarylate and polycarbonate may be used. These binding resins may be used separately or in combination as a mixture or copolymer of two or more of these binding resins.

Examples of the solvent used for the charge transport layer coating liquid include alcohol-based solvents, sulfoxide-based solvents, ketone-based solvents, ether-based solvents, ester-based solvents, and aromatic hydrocarbon-based solvents. These solvents may be used separately or in combination of two or more.

The ratio of the charge transport material to the binding resin contained in the charge transport layer, i.e., charge transport material/binding resin, may be 0.3/1 or more and 10/1 or less (mass ratio).

The heating temperature (drying temperature) of the coat of the charge transport layer coating liquid is preferably 60° C. or higher and 150° C. or lower and more preferably 80° C. or higher and 120° C. or lower from the viewpoint of inhibiting the occurrence of cracking of the charge transport layer. The heating time (drying time) may be 10 minutes or more and 60 minutes or less.

In the case where the charge transport layer in the electrophotographic photosensitive member is a single layer, the charge transport layer preferably has a thickness of 5 μm or more and 40 μm or less and more preferably 8 μm or more and 30 μm or less.

In the case where the charge transport layer has a laminated structure, the charge transport layer on the support side may have a thickness of 5 μm or more and 30 μm or less. The charge transport layer on the surface side may have a thickness of 1 μm or more and 10 μm or less.

The charge transport layer may further contain an antioxidant, an ultraviolet absorbing agent, a plasticizer, and so forth, as needed.

In an embodiment of the present invention, a protective layer may be disposed on the photosensitive layer (charge transport layer) for the purpose of improving the endurance and the cleaning performance of the electrophotographic photosensitive member.

The protective layer may be formed by applying a protective layer coating liquid and drying and/or curing the resulting coat, the protective layer coating liquid being prepared by dissolving a resin (or a monomer and/or an oligomer to be formed into the resin) in a solvent.

Examples of the resin used for the protective layer include polyvinyl butyral, polyester, polycarbonate, polyamide, polyimide, polyarylate, urethane resins, acrylic resins, methacrylic resins, styrene-butadiene copolymers, styrene-acrylic acid copolymers, and styrene-acrylonitrile copolymers. Among these resins, acrylic resins and methacrylic resins may be used. These resins may be used separately or in combination of two or more.

To impart charge transport ability to the protective layer, the protective layer (second charge transport layer) may be formed by curing a monomer having charge transport ability (hole transport ability) through a polymerization reaction, crosslinking reaction, or the like. Specifically, the protective layer (second charge transport layer) may be formed by curing a charge transport compound (hole transport compound) having a chain-polymerizable functional group through polymerizing or crosslinking.

Examples of the chain-polymerizable functional group include an acryloyloxy group, a methacryloyloxy group, an alkoxysilyl group, and an epoxy group. Examples of the curing reaction include a radical polymerization reaction and ionic polymerization reaction. The curing reaction may be performed by the application of, for example, heat, light, such as ultraviolet rays, radiation, such as an electron beam.

The protective layer may further contain conductive particles, an ultraviolet absorbing agent, a wear-resistance improver, and so forth, as needed. Examples of the conductive particles include metal oxide particles, such as tin oxide particles. Examples of the wear-resistance improver include fluorine atom-containing resin particles, such as polytetrafluoroethylene particles; alumina; and silica.

The protective layer preferably has a thickness of 0.5 μm or more and 20 μm or less and more preferably 1 μm or more and 10 μm or less.

When the coating liquids for the foregoing layers are applied, for example, application methods, such as a dip coating method, a spray coating method, a spin coating method, a roller coating method, a Meyer bar coating method, and a blade coating method, may be employed.

Figure 2:
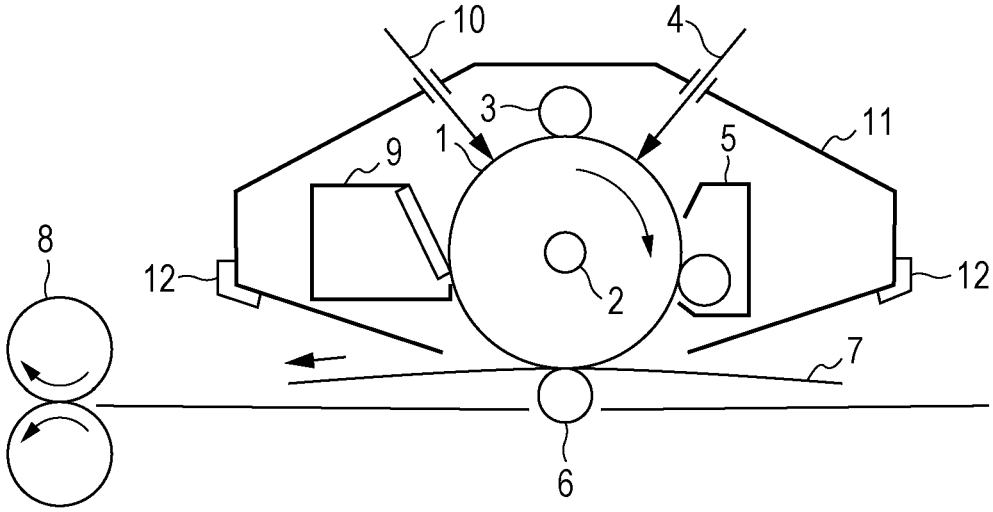
FIG. 2 illustrates a schematic structure of an electrophotographic apparatus provided with a process cartridge including an electrophotographic photosensitive member produced by the production method according to an embodiment of the present invention.

FIG. 2 illustrates a schematic structure of an electrophotographic apparatus equipped with a process cartridge including the electrophotographic photosensitive member according to an embodiment of the present invention.

In FIG. 2, a cylindrical (drum-shaped) electrophotographic photosensitive member 1 according to an embodiment of the present invention is rotationally driven around a shaft 2 at a predetermined circumferential velocity (process speed) in the direction indicated by an arrow.

A surface (peripheral surface) of the electrophotographic photosensitive member 1 is uniformly charged to a predetermined positive or negative potential with a charging device 3 (primary charging device, e.g., a charging roller) during rotation.

Then, the surface of the electrophotographic photosensitive member 1 is irradiated with exposure light (image exposure light) 4 emitted from an exposure device (image exposure device, not illustrated).

Thereby, an electrostatic latent image is formed on the surface of the electrophotographic photosensitive member 1.

The electrostatic latent image formed on the surface of the electrophotographic photosensitive member 1 is then developed with a developing agent (toner) in a developing device 5 (by normal or reversal developing) to form a toner image on the surface of the electrophotographic photosensitive member 1.

The toner image formed on the surface of the electrophotographic photosensitive member 1 is transferred onto a transfer material 7 with a transfer device 6 (e.g., a transfer roller).

The transfer material 7 is removed from a transfer material feeding unit (not illustrated) in synchronization with the rotation of the electrophotographic photosensitive member 1 and fed to a portion (contact portion) between the electrophotographic photosensitive member 1 and the transfer device 6.

A voltage (transfer bias) having a reverse polarity to the charge polarity of the toner is applied to the transfer device 6 from a bias supply (not illustrated).

The transfer material 7 to which the toner image has been transferred is separated from the surface of the electrophotographic photosensitive member 1, conveyed to a fixing device 8, subjected to fixation of the toner image, and conveyed as an image formed product (print or copy) to the outside of the electrophotographic apparatus.

The transfer device 6 may be a transfer device including a primary transfer member, an intermediate transfer member, a secondary transfer member, and so forth and employing an intermediate transfer method.

The surface of the electrophotographic photosensitive member 1 after the transfer of the toner image to the transfer material 7 is cleaned with a cleaning device 9 (e.g., a cleaning blade) to remove adherents, such as the residual developing agent (residual toner).

The residual toner may also be recovered with the developing device or the like (a cleaner-less system).

The surface of the electrophotographic photosensitive member 1 is subjected to charge elimination by irradiation with pre-exposure light 10 emitted from a pre-exposure device (not illustrated) and then is repeatedly used for image formation.

As illustrated in FIG. 2, in the case where the charging device 3 is a contact charging device including a charging roller and so forth, the pre-exposure light is not always required.

In an embodiment of the present invention, a plurality of components selected from the components, such as the electrophotographic photosensitive member 1, the charging device 3, the developing device 5, and the cleaning device 9, may be arranged in a housing and integrally combined to form a process cartridge.

The process cartridge may be detachably attached to the main body of the electrophotographic apparatus. For example, at least one selected from the charging device 3, the developing device 5, the transfer device 6, and the cleaning device 9 is supported together with the electrophotographic photosensitive member 1 into a process cartridge 11 detachably attached to the main body of the electrophotographic apparatus using guiding devices 12, such as rails of the main body of the electrophotographic apparatus.

For example, the exposure light 4 may be reflected or transmitted light through a document. Furthermore, the exposure light 4 may be light emitted by, for example, scanning of a laser beam, or driving of a light-emitting diode (LED) array or a liquid crystal shutter array, in which the scanning and driving are controlled in response to signals into which information of a document read by a sensor is converted.

EXAMPLES

While the present invention will be described in more detail below by specific examples, the present invention is not limited thereto. Here, the term "part(s)" in examples indicates "part(s) by mass".

Example 1

Preparation of Coating Liquid for an Undercoat Layer

First, 100 parts of zinc oxide particles (specific surface area: 19 $m^2/g$, powder resistivity: $3.7\times10^5$ Ω·cm, hereinafter, also referred to as "zinc oxide particles (1)") was mixed with 500 parts of toluene under stirring. Then 1.5 parts of N-(2-aminoethyl)-3-aminopropylmethyldimethoxysilane (trade name: KBM-602, manufactured by Shin-Etsu Chemical Co., Ltd.), serving as a silane coupling agent (surface treatment agent), was added thereto. The mixture was stirred for 6 hours. Toluene was removed under reduced pressure. The resulting mixture was dried for 6 hours at 140° C. to give zinc oxide particles surface-treated with the silane coupling agent.

Next, 15 parts of a butyral resin (trade mane: BM-1, manufactured by Sekisui Chemical Co., Ltd.) serving as a polyol and 15 parts of a composition containing a blocked isocyanate compound whose isocyanate group was blocked with a structure represented by the formula (1) (X: an oxygen atom, $R^1$: an ethyl group, and $R^2$: an ethyl group) (the blocked isocyanate compound content: 75% by mass (the balance: a solvent), the solvent: naphtha and butyl acetate) were dissolved in a solvent mixture of 73.5 parts of methyl ethyl ketone and 73.5 parts of 1-butanol to give a solution.

To the solution, 81 parts of the zinc oxide particles surface-treated with the silane coupling agent and 0.8 parts of 2,3,4-trihydroxybenzophenone (manufactured by Tokyo Chemical Industry Co., Ltd.) were added. The resulting mixture was charged into a vertical sand mill together with 180 parts of glass beads, serving as dispersion media, having an average particle diameter of 1.0 mm. The mixture was subjected to dispersion treatment for 4 hours in an atmosphere at 23±3° C. under conditions including a rotation speed of 1500 rpm (a peripheral speed of 5.5 m/s).

After the dispersion treatment, 0.01 parts of a silicone oil (trade name: SH28PA, manufactured by Dow Corning Toray silicone Co., Ltd.) was added thereto. Furthermore, 5.6 parts of crosslinked polymethyl methacrylate (PMMA) particles (trade name: TECHPOLYMER SSX-102, manufactured by Sekisui Plastics Co., Ltd., average primary particle diameter: 2.5 μm) were added thereto. The resulting mixture was stirred to prepare a coating liquid for an undercoat layer.

The number-average particle diameter of the zinc oxide particles in the coating liquid for an undercoat layer was measured 1 day after the preparation and found to be 220 nm.

The viscosity of the coating liquid for an undercoat layer was also measured and found to be 250 mPa·s.

The resulting coating liquid for an undercoat layer was charged into a cylindrical vessel and stirred with a pot mill at 1 rotation per second for 1 month after the preparation. Then the number-average particle diameter of the zinc oxide particles in the coating liquid for an undercoat layer was measured and found to be 225 nm. The viscosity of the coating liquid for an undercoat layer was measured and found to be 261 mPa·s.

The measurement of the number-average particle diameter of the zinc oxide particles in the coating liquid for an undercoat layer was performed by diluting the coating liquid for an undercoat layer with 1-butanol and measuring the number-average particle diameter with a particle size analyzer (trade name: Zetasizer Nano, manufactured by Sysmex Corporation). The measurement of the viscosity of the coating liquid for an undercoat layer was performed with a Brookfield type viscometer (trade name: Vismetron Model VS-A1, a single cylinder type rotational viscometer, manufactured by Shibaura System Co., Ltd.) at a measurement temperature of 23° C. and a rotation speed of 60 rpm.

Production of Electrophotographic Photosensitive Member 1

An aluminum cylinder (JIS-A3003, an ED tube of an aluminum alloy, manufactured by Showa Aluminum Corporation) was used as a support, the aluminum cylinder being produced by hot extrusion under an environment of 23° C./60% RH and having a length of 357.5 mm and a diameter of 30 mm.

The coating liquid for an undercoat layer prepared as described above was stirred with a pot mill at 1 rotation per second for 1 day. Then the coating liquid for an undercoat layer was applied onto the support by dipping to form a coat. The resulting coat of the coating liquid for an undercoat layer was dried and cured by heating to 150° C. for 30 minutes, thereby forming an undercoat layer having a thickness of 30 μm.

Next, 2 parts of polyvinyl butyral (trade name: S-LEC BX-1, manufactured by Sekisui Chemical Co., Ltd.) was dissolved in 100 parts of cyclohexanone. To the resulting solution, 4 parts of hydroxygallium phthalocyanine crystals (charge generation material) of a crystal form that exhibits strong peaks at 7.4° and 28.1° of Bragg angles (2θ±0.2°) in X-ray diffraction with CuKα characteristic radiation and 0.04 parts of a compound represented by the structural formula (A):

(A)

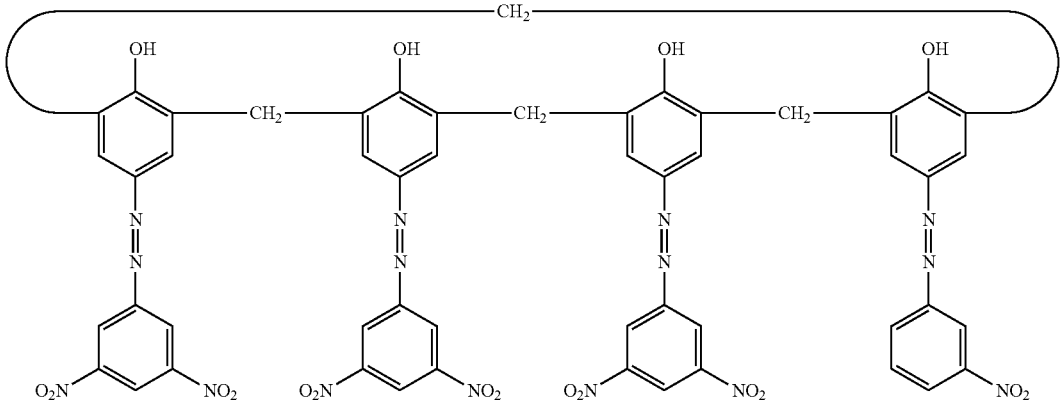

were added. The resulting mixture was charged into a sand mill together with glass beads 1 mm in diameter. The mixture was subjected to dispersion treatment for 1 hour in an atmosphere at 23±3° C. After the dispersion treatment, 100 parts of ethyl acetate was added thereto, thereby preparing a charge generation layer coating liquid. The charge generation layer coating liquid was applied onto the undercoat layer by dipping. The resulting coat was dried for 10 minutes at 90° C. to form a charge generation layer having a thickness of 0.20 p.m.

Next, 50 parts of an amine compound (a charge transport material (a hole transport material)) represented by the structural formula (B):

(B)

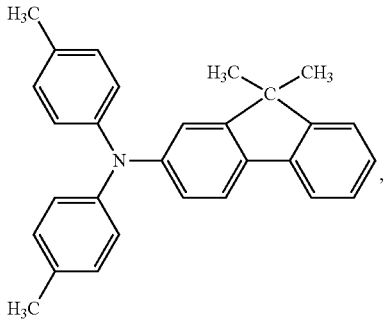

50 parts of an amine compound (a charge transport material (a hole transport material)) represented by the structural formula (C):

(C)

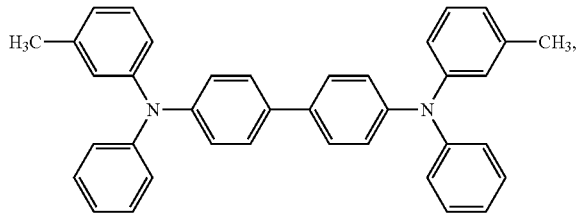

and 100 parts of polycarbonate (trade name: Iupilon 2400, manufactured by Mitsubishi Gas Chemical Company, Inc.) were dissolved in a solvent mixture of 650 parts of chlorobenzene and 150 parts of dimethoxymethane, thereby preparing a charge transport layer coating liquid. After the charge transport layer coating liquid was allowed to stand for 1 day, the charge transport layer coating liquid was applied onto the charge generation layer by dipping. The resulting coat was dried for 30 minutes at 110° C., thereby forming a charge transport layer having a thickness of 21 μm.

Next, 36 parts of a compound (D) represented by the following structural formula:

(D)

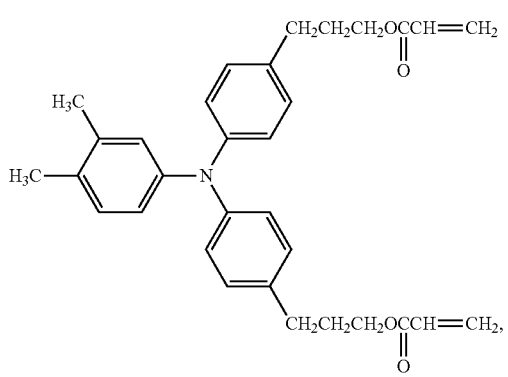

4 parts of polytetrafluoroethylene particles (trade name: Lubron L-2, manufactured by Daikin Industries, Ltd.), and 60 parts of n-propyl alcohol were mixed. The resulting mixture was charged into an ultrahigh-pressure disperser and subjected to dispersion treatment, thereby preparing a protective layer coating liquid (a second charge transport layer coating liquid).

The protective layer coating liquid was applied onto the charge transport layer by dipping. The resulting coat was dried for 5 minutes at 50° C. After the drying, the coat was irradiated with an electron beam in a nitrogen atmosphere under conditions including an acceleration voltage of 70 kV and an absorbed dose of 8000 Gy for 1.6 seconds with the support rotated. Then the coat was subjected to heat treatment for 3 minutes in a nitrogen atmosphere under conditions such that the coat was heated to 130° C. The oxygen concentration was 20 ppm from the electron beam irradiation to the heat treatment for 3 minutes. The coat was then subjected to heat treatment for 30 minutes in air under conditions such that the coat was heated to 100° C., thereby forming a protective layer (second charge transport layer) having a thickness of 5 μm.

In this way, the drum-shaped electrophotographic photosensitive member 1 (photoconductive drum) including, in sequence, the support, the undercoat layer, the charge generation layer, the charge transport layer, and the protective layer (second charge transport layer) was produced.

Evaluations were described below.

The produced electrophotographic photosensitive member 1 was mounted on a copier (trade name: GP405, manufactured by CANON KABUSHIKI KAISHA) employing an electrophotographic method. A solid white image (A4-size paper) was outputted and evaluated for a black spot. The A4-sized paper was conveyed in the direction of a short side. The charging device of the copier is a contact charging device including a charging roller. A voltage in which an alternating voltage was superimposed on a direct current voltage was applied to the charging roller.

Evaluation criteria (ranks and numbers) for a black spot in the solid white image outputted are described below.

In the outputted solid white image, the evaluation of the number of black spots in a rectangular region having a length of 297 mm, which is equal to the length of the long side of a A4-sized sheet, and a width of 94.2 mm, which is equal to the circumference of the electrophotographic photosensitive member (hereinafter, referred to as the "area corresponding to the circumference of the electrophotographic photosensitive member") was made.

A: The number of black spots each having a diameter of 0.3 mm or more is zero per area corresponding to the circumference of the electrophotographic photosensitive member in the solid white image.

B: The number of black spots each having a diameter of 0.3 mm or more is 1 or more and 3 or less per area corresponding to the circumference of the electrophotographic photosensitive member in the solid white image.

C: The number of black spots each having a diameter of 0.3 mm or more is 4 per area corresponding to the circumference of the electrophotographic photosensitive member in the solid white image.

D: The number of black spots each having a diameter of 0.3 mm or more is 5 per area corresponding to the circumference of the electrophotographic photosensitive member in the solid white image.

E: The number of black spots each having a diameter of 0.3 mm or more is 6 or more per area corresponding to the circumference of the electrophotographic photosensitive member in the solid white image.

Tables 7, 8, and 9 illustrate the results (the ranks and the numbers of black spots).

Examples 2 to 7

Coating liquids for undercoat layers were prepared as in Example 1, except that the amounts of methyl ethyl ketone and 1-butanol used for the preparation of the coating liquids for undercoat layers were different from those in Example 1 and illustrated in Table 2. The number-average particle diameter of the zinc oxide particles and the viscosity of each of the coating liquids for undercoat layers were measured as in Example 1. Electrophotographic photosensitive members were produced as in Example 1, except that the respective prepared coating liquids for undercoat layers were used. Then the electrophotographic photosensitive members were evaluated. Table 7 illustrates the results.

Examples 8 to 12

Coating liquids for undercoat layers were prepared as in Example 1, except that 81 parts of another type of zinc oxide particles (specific surface area: 40 $m^2/g$, powder resistivity: $1.6\times10^6$ Ω·cm, hereinafter, also referred to as "zinc oxide particles (2)") were used in place of 81 parts of the zinc oxide particles used for the preparation of the coating liquid for an undercoat layer in Example 1 and that the amounts of methyl ethyl ketone and 1-butanol used for the preparation of the coating liquids for undercoat layers were different from those in Example 1 and illustrated in Table 2. The number-average particle diameter of the zinc oxide particles and the viscosity of each of the coating liquids for undercoat layers were measured as in Example 1. Electrophotographic photosensitive members were produced as in Example 1, except that the respective prepared coating liquids for undercoat layers were used. Then the electrophotographic photosensitive members were evaluated. Table 7 illustrates the results.

Examples 13 to 15

Coating liquids for undercoat layers were prepared as in Example 1, except that 20 parts of another butyral resin (trade name: BM-S, manufactured by Sekisui Chemical Co., Ltd.) was used in place of 15 parts of the butyral resin used for the preparation of the coating liquid for an undercoat layer in Example 1 and that the amounts of methyl ethyl ketone and 1-butanol used for the preparation of the coating liquids for undercoat layers were different from those in Example 1 and illustrated in Table 2. The number-average particle diameter of the zinc oxide particles and the viscosity of each of the coating liquids for undercoat layers were measured as in Example 1. Electrophotographic photosensitive members were produced as in Example 1, except that the respective prepared coating liquids for undercoat layers were used. Then the electrophotographic photosensitive members were evaluated. Table 7 illustrates the results.

Example 16

A coating liquid for an undercoat layer was prepared as in Example 1, except that 17 parts of polyacrylic polyol (trade name: Burnock WE-310, manufactured by DIC Corporation) was used in place of 15 parts of the butyral resin used for the preparation of the coating liquid for an undercoat layer in Example 1. The number-average particle diameter of the zinc oxide particles and the viscosity of the coating liquid for an undercoat layer were measured as in Example 1. An electrophotographic photosensitive member was produced as in Example 1, except that the prepared coating liquid for an undercoat layer was used. Then the electrophotographic photosensitive member was evaluated. Table 7 illustrates the results.

Example 17

A coating liquid for an undercoat layer was prepared as in Example 1, except that 15 parts of another butyral resin (trade name: BX-1, manufactured by Sekisui Chemical Co., Ltd.) was used in place of 15 parts of the butyral resin used for the preparation of the coating liquid for an undercoat layer in Example 1. The number-average particle diameter of the zinc oxide particles and the viscosity of the coating liquid for an undercoat layer were measured as in Example 1. An electrophotographic photosensitive member was produced as in Example 1, except that the prepared coating liquid for an undercoat layer was used. Then the electrophotographic photosensitive member was evaluated. Table 7 illustrates the results.

Examples 18 to 22

Coating liquids for undercoat layers were prepared as in Example 1, except that 15 parts of a composition containing a blocked isocyanate compound whose isocyanate group was blocked with a structure represented by the formula (1) (X: a single bond, $R^1$: an ethyl group, $R^2$: a methyl group) (the blocked isocyanate compound content: 59.8% by mass (the balance: a solvent), the solvent: 1-butanol/n-butyl acetate/another solvent (which is not a monohydric alcohol, a ketone-based solvent, or a cyclic ether-based solvent)=24.7/13.8/1.7 (mass ratio)) was used in place of 15 parts of the composition containing the blocked isocyanate compound used for the preparation of each of the coating liquids for undercoat layers in Examples 8 to 12. The number-average particle diameter of the zinc oxide particles and the viscosity of each of the coating liquids for undercoat layers were measured as in Example 8 to 12. Electrophotographic photosensitive members were produced as in Example 8 to 12, except that the respective prepared coating liquids for undercoat layers were used. Then the electrophotographic photosensitive members were evaluated. Table 7 illustrates the results.

Example 23

A coating liquid for an undercoat layer was prepared as in Example 1, except that 0.8 parts of alizarin (1,2-dihydroxyanthraquinone, manufactured by Tokyo Chemical Industry Co., Ltd.) was used in place of 2,3,4-trihydroxybenzophenone used for the preparation of the coating liquid for an undercoat layer in Example 1. The number-average particle diameter of the zinc oxide particles and the viscosity of the coating liquid for an undercoat layer were measured as in Example 1. An electrophotographic photosensitive member was produced as in Example 1, except that the prepared coating liquid for an undercoat layer was used. Then the electrophotographic photosensitive member was evaluated. Table 7 illustrates the results.

Example 24

A coating liquid for an undercoat layer was prepared as in Example 1, except that 2,3,4-trihydroxybenzophenone used for the preparation of the coating liquid for an undercoat layer in Example 1 was not used. The number-average particle diameter of the zinc oxide particles and the viscosity of the coating liquid for an undercoat layer were measured as in Example 1. An electrophotographic photosensitive member was produced as in Example 1, except that the prepared coating liquid for an undercoat layer was used. Then the electrophotographic photosensitive member was evaluated. Table 7 illustrates the results.

Examples 25 to 34

Coating liquids for undercoat layers were prepared as in Example 1, except that solvents used for the preparation of the coating liquids for undercoat layers were different from those in Example 1 and illustrated in Tables 2 and 4. The number-average particle diameter of the zinc oxide particles and the viscosity of each of the coating liquids for undercoat layers were measured as in Example 1. Electrophotographic photosensitive members were produced as in Example 1, except that the respective prepared coating liquids for undercoat layers were used. Then the electrophotographic photosensitive members were evaluated. Tables 7 and 8 illustrate the results.

Examples 35 to 39

Coating liquids for undercoat layers were prepared as in Example 1, except that zinc oxide particles that were not subjected to surface treatment were used for the preparation of the coating liquids for undercoat layers and that the amounts of methyl ethyl ketone and 1-butanol used for the preparation of the coating liquids for undercoat layers were different from those in Example 1 and illustrated in Table 4. The number-average particle diameter of the zinc oxide particles and the viscosity of each of the coating liquids for undercoat layers were measured as in Example 1. Electrophotographic photosensitive members were produced as in Example 1, except that the respective prepared coating liquids for undercoat layers were used. Then the electrophotographic photosensitive members were evaluated. Table 8 illustrates the results.

Examples 40~53

Coating liquids for undercoat layers were prepared as in Example 1, except that the amounts of the materials used for the preparation of the coating liquids for undercoat layers were different from those in Example 1 and illustrated in Tables 3 and 4. The number-average particle diameter of the zinc oxide particles and the viscosity of each of the coating liquids for undercoat layers were measured as in Example 1. Electrophotographic photosensitive members were produced as in Example 1, except that the respective prepared coating liquids for undercoat layers were used. Then the electrophotographic photosensitive members were evaluated. Table 8 illustrates the results.

Example 54

A coating liquid for an undercoat layer was prepared as in Example 1, except that 1.5 parts of N-(2-aminoethyl)-3-aminopropyltrimethoxysilane (trade name: KBM-603, manufactured by Shin-Etsu Chemical Co., Ltd.) was used in place of 1.5 parts of N-(2-aminoethyl)-3-aminopropylmethyldimethoxysilane used for the surface treatment of the zinc oxide particles in Example 1. The number-average particle diameter of the zinc oxide particles and the viscosity of the coating liquid for an undercoat layer were measured as in Example 1. An electrophotographic photosensitive member was produced as in Example 1, except that the prepared coating liquid for an undercoat layer was used. Then the electrophotographic photosensitive member was evaluated. Table 8 illustrates the results.

Example 55

An electrophotographic photosensitive member was produced as in Example 1, except that the heating temperature of the coat of the coating liquid for an undercoat layer was changed from 150° C. to 130° C. Then the electrophotographic photosensitive member was evaluated. Table 8 illustrates the results.

Example 56

An electrophotographic photosensitive member was produced as in Example 1, except that the heating temperature of the coat of the coating liquid for an undercoat layer was changed from 150° C. to 190° C. Then the electrophotographic photosensitive member was evaluated. Table 8 illustrates the results.

Example 57

An electrophotographic photosensitive member was produced as in Example 1, except that the heating temperature of the coat of the coating liquid for an undercoat layer was changed from 150° C. to 100° C. Then the electrophotographic photosensitive member was evaluated. Table 8 illustrates the results.

Comparative Examples 1 to 19

Coating liquids for undercoat layers were prepared as in Example 1, except that the types and amounts of the materials used for the preparation of the coating liquids for undercoat layers different from those in Example 1 and illustrated in Tables 5 and 6. The number-average particle diameter of the zinc oxide particles and the viscosity of each of the coating liquids for undercoat layers were measured as in Example 1. Table 9 illustrates the results. Electrophotographic photosensitive members were produced as in Example 1, except that the respective prepared coating liquids for undercoat layers were used. Then the electrophotographic photosensitive members were evaluated. Table 9 illustrates the results.

TABLE 1

| | Material for coating liquid for undercoat layer | | | | | | | | |
|---|---|---|---|---|---|---|---|---|---|
| | Zinc oxide particles | | | Polyol | | Blocked isocyanate compound whose isocyanate group is blocked with structure represented by formula (1) | | Others | |
| Example | Type | Type of surface treatment agent | Amount [part] | Type | Amount [part] | Group in formula (1) | Amount [part] | Type | Amount [part] |
| 1 | zinc oxide particles (1) | KBM602 | 81 | butyral resin (BM-1) | 15 | X: oxygen atom<br>$R^1$: ethyl group<br>$R^2$: ethyl group | 15 × 0.75 | 2,3,4-trihydroxybenzophenone | 0.8 |
| 2 | " | " | " | " | " | X: oxygen atom<br>$R^1$: ethyl group<br>$R^2$: ethyl group | " | 2,3,4-trihydroxybenzophenone | " |
| 3 | " | " | " | " | " | X: oxygen atom<br>$R^1$: ethyl group<br>$R^2$: ethyl group | " | 2,3,4-trihydroxybenzophenone | " |
| 4 | " | " | " | " | " | X: oxygen atom<br>$R^1$: ethyl group<br>$R^2$: ethyl group | " | 2,3,4-trihydroxybenzophenone | " |
| 5 | " | " | " | " | " | X: oxygen atom<br>$R^1$: ethyl group<br>$R^2$: ethyl group | " | 2,3,4-trihydroxybenzophenone | " |

TABLE 1-continued

| | Material for coating liquid for undercoat layer | | | | | | | | |
|---|---|---|---|---|---|---|---|---|---|
| | Zinc oxide particles | | | Polyol | | Blocked isocyanate compound whose isocyanate group is blocked with structure represented by formula (1) | | Others | |
| Example | Type | Type of surface treatment agent | Amount [part] | Type | Amount [part] | Group in formula (1) | Amount [part] | Type | Amount [part] |
| 6 | " | " | " | " | " | X: oxygen atom<br>$R^1$: ethyl group<br>$R^2$: ethyl group | " | 2,3,4-trihydroxy-benzophenone | " |
| 7 | " | " | " | " | " | X: oxygen atom<br>$R^1$: ethyl group<br>$R^2$: ethyl group | " | 2,3,4-trihydroxy-benzophenone | " |
| 8 | zinc oxide particles (2) | " | " | " | " | X: oxygen atom<br>$R^1$: ethyl group<br>$R^2$: ethyl group | " | 2,3,4-trihydroxy-benzophenone | " |
| 9 | " | " | " | " | " | X: oxygen atom<br>$R^1$: ethyl group<br>$R^2$: ethyl group | " | 2,3,4-trihydroxy-benzophenone | " |
| 10 | " | " | " | " | " | X: oxygen atom<br>$R^1$: ethyl group<br>$R^2$: ethyl group | " | 2,3,4-trihydroxy-benzophenone | " |
| 11 | " | " | " | " | " | X: oxygen atom<br>$R^1$: ethyl group<br>$R^2$: ethyl group | " | 2,3,4-trihydroxy-benzophenone | " |
| 12 | " | " | " | " | " | X: oxygen atom<br>$R^1$: ethyl group<br>$R^2$: ethyl group | " | 2,3,4-trihydroxy-benzophenone | " |
| 13 | zinc oxide particles (1) | " | " | butyral resin (BM-S) | 20 | X: oxygen atom<br>$R^1$: ethyl group<br>$R^2$: ethyl group | " | 2,3,4-trihydroxy-benzophenone | " |
| 14 | " | " | " | " | " | X: oxygen atom<br>$R^1$: ethyl group<br>$R^2$: ethyl group | " | 2,3,4-trihydroxy-benzophenone | " |
| 15 | " | " | " | " | " | X: oxygen atom<br>$R^1$: ethyl group<br>$R^2$: ethyl group | " | 2,3,4-trihydroxy-benzophenone | " |
| 16 | " | " | " | polyacrylic polyol (WE-310) | 17 | X: oxygen atom<br>$R^1$: ethyl group<br>$R^2$: ethyl group | " | 2,3,4-trihydroxy-benzophenone | " |
| 17 | " | " | " | butyral resin (BX-1) | 15 | X: oxygen atom<br>$R^1$: ethyl group<br>$R^2$: ethyl group | " | 2,3,4-trihydroxy-benzophenone | " |
| 18 | " | " | " | " | " | X: single bond<br>$R^1$: ethyl group<br>$R^2$: methyl group | 15 × 0.598 | 2,3,4-trihydroxy-benzophenone | " |
| 19 | " | " | " | " | " | X: single bond<br>$R^1$: ethyl group<br>$R^2$: methyl group | " | 2,3,4-trihydroxy-benzophenone | " |
| 20 | " | " | " | " | " | X: single bond<br>$R^1$: ethyl group<br>$R^2$: methyl group | " | 2,3,4-trihydroxy-benzophenone | " |
| 21 | " | " | " | " | " | X: single bond<br>$R^1$: ethyl group<br>$R^2$: methyl group | " | 2,3,4-trihydroxy-benzophenone | " |
| 22 | " | " | " | " | " | X: single bond<br>$R^1$: ethyl group<br>$R^2$: methyl group | " | 2,3,4-trihydroxy-benzophenone | " |
| 23 | " | " | " | " | " | X: oxygen atom<br>$R^1$: ethyl group<br>$R^2$: ethyl group | 15 × 0.75 | alizarin | 0.8 |
| 24 | " | " | " | " | " | X: oxygen atom<br>$R^1$: ethyl group<br>$R^2$: ethyl group | " | — | — |
| 25 | " | " | " | " | " | X: oxygen atom<br>$R^1$: ethyl group<br>$R^2$: ethyl group | " | 2,3,4-trihydroxy-benzophenone | 0.8 |
| 26 | " | " | " | " | " | X: oxygen atom<br>$R^1$: ethyl group<br>$R^2$: ethyl group | " | 2,3,4-trihydroxy-benzophenone | " |
| 27 | " | " | " | " | " | X: oxygen atom<br>$R^1$: ethyl group<br>$R^2$: ethyl group | " | 2,3,4-trihydroxy-benzophenone | " |
| 28 | " | " | " | " | " | X: oxygen atom<br>$R^1$: ethyl group<br>$R^2$: ethyl group | " | 2,3,4-trihydroxy-benzophenone | " |

TABLE 1-continued

| | Material for coating liquid for undercoat layer | | | | | | | | |
|---|---|---|---|---|---|---|---|---|---|
| | Zinc oxide particles | | | Polyol | | Blocked isocyanate compound whose isocyanate group is blocked with structure represented by formula (1) | | Others | |
| Example | Type | Type of surface treatment agent | Amount [part] | Type | Amount [part] | Group in formula (1) | Amount [part] | Type | Amount [part] |
| 29 | " | " | " | " | " | X: oxygen atom<br>$R^1$: ethyl group<br>$R^2$: ethyl group | " | 2,3,4-trihydroxy-benzophenone | " |

TABLE 2

| | Material for coating liquid for undercoat layer Solvent mixture | | | | | |
|---|---|---|---|---|---|---|
| | Monohydric alcohol | | | | Ketone-based solvent/cyclic ether-based solvent | |
| Example | Type | Amount [part] | Amount based on structure represented by formula (1) [chemical equivalent] | Amount based on solvent mixture [% by mass] | Type | Amount [part] |
| 1 | 1-butanol | 73.5 | 59.8 | 49 | methyl ethyl ketone | 73.5 |
| 2 | " | 47 | 38.2 | 31 | " | 101 |
| 3 | " | 15 | 12.2 | 10 | " | 132 |
| 4 | " | 2 | 1.6 | 1 | " | 159 |
| 5 | " | 20 | 16.3 | 28 | " | 48 |
| 6 | " | 132 | 107.3 | 88 | " | 15 |
| 7 | " | 123 | 100.0 | 90 | " | 10 |
| 8 | " | 73.5 | 59.8 | 49 | " | 73.5 |
| 9 | " | 15 | 12.2 | 10 | " | 132 |
| 10 | " | 2 | 1.6 | 1 | " | 159 |
| 11 | " | 132 | 107.3 | 88 | " | 15 |
| 12 | " | 123 | 100.0 | 90 | " | 10 |
| 13 | " | 73.5 | 52.7 | 49 | " | 73.5 |
| 14 | " | 15 | 10.8 | 10 | " | 132 |
| 15 | " | 132 | 94.7 | 88 | " | 15 |
| 16 | " | 73.5 | 44.8 | 49 | " | 73.5 |
| 17 | " | 73.5 | 59.8 | 49 | " | 73.5 |
| 18 | " | 73.5 + 15 × 0.247 | 64 | 50 | " | 73.5 |
| 19 | " | 15 + 15 × 0.247 | 16 | 12 | " | 132 |
| 20 | " | 2 + 15 × 0.247 | 5 | 4 | " | 137 |
| 21 | " | 129 + 15 × 0.247 | 113 | 88 | " | 15 |
| 22 | " | 107 + 15 × 0.247 | 92 | 90 | " | 10 |
| 23 | " | 73.5 | 59.8 | 49 | " | 73.5 |
| 24 | " | 73.5 | 59.8 | 49 | " | 73.5 |
| 25 | ethanol | 73.5 | 59.8 | 49 | acetone | 73.5 |
| 26 | " | 15 | 12.2 | 10 | " | 132 |
| 27 | " | 2 | 1.6 | 1 | " | 159 |
| 28 | " | 132 | 107.3 | 88 | " | 15 |
| 29 | " | 123 | 100.0 | 90 | " | 10 |

| | Material for coating liquid for undercoat layer Solvent mixture | | | |
|---|---|---|---|---|
| | Ketone-based solvent/cyclic ether-based solvent | Other solvents | | |
| Example | Amount based on solvent mixture [% by mass] | Type | Amount [part] | Amount based on solvent mixture [% by mass] |
| 1 | 49 | naphtha, butyl acetate | 15 × 0.25 | 2 |
| 2 | 67 | " | " | 2 |
| 3 | 88 | " | " | 2 |
| 4 | 97 | " | " | 2 |
| 5 | 67 | " | " | 5 |
| 6 | 10 | " | " | 2 |
| 7 | 7 | " | " | 3 |
| 8 | 49 | " | " | 2 |
| 9 | 88 | " | " | 2 |
| 10 | 97 | " | " | 2 |

TABLE 2-continued

| | | | | |
|---|---|---|---|---|
| 11 | 10 | " | " | 2 |
| 12 | 7 | " | " | 3 |
| 13 | 49 | " | " | 2 |
| 14 | 88 | " | " | 2 |
| 15 | 10 | " | " | 2 |
| 16 | 49 | " | " | 2 |
| 17 | 49 | " | " | 2 |
| 18 | 48 | n-butyl acetate, others | 15 × 0.155 | 2 |
| 19 | 86 | " | 15 × 0.155 | 2 |
| 20 | 94 | " | 15 × 0.155 | 2 |
| 21 | 10 | " | 15 × 0.155 | 2 |
| 22 | 8 | " | 15 × 0.155 | 2 |
| 23 | 49 | naphtha, butyl acetate | 15 × 0.25 | 2 |
| 24 | 49 | " | " | 2 |
| 25 | 49 | " | " | 2 |
| 26 | 88 | " | " | 2 |
| 27 | 97 | " | " | 2 |
| 28 | 10 | " | " | 2 |
| 29 | 7 | " | " | 3 |

TABLE 3

| | Material for coating liquid for undercoat layer | | | | | | | | |
|---|---|---|---|---|---|---|---|---|---|
| | Zinc oxide particles | | | Polyol | | Blocked isocyanate compound whose isocyanate group is blocked with structure represented by formula (1) | | Others | |
| Example | Type | Type of surface treatment agent | Amount [part] | Type | Amount [part] | Group in formula (1) | Amount [part] | Type | Amount [part] |
| 30 | zinc oxide particles (1) | KBM602 | 81 | butyral resin (BM-1) | 15 | X: oxygen atom<br>$R^1$: ethyl group<br>$R^2$: ethyl group | 15 × 0.75 | 2,3,4-trihydroxybenzophenone | 0.8 |
| 31 | zinc oxide particles (1) | " | " | " | " | X: oxygen atom<br>$R^1$: ethyl group<br>$R^2$: ethyl group | " | 2,3,4-trihydroxybenzophenone | " |
| 32 | zinc oxide particles (1) | " | " | " | " | X: oxygen atom<br>$R^1$: ethyl group<br>$R^2$: ethyl group | " | 2,3,4-trihydroxybenzophenone | " |
| 33 | zinc oxide particles (1) | " | " | " | " | X: oxygen atom<br>$R^1$: ethyl group<br>$R^2$: ethyl group | " | 2,3,4-trihydroxybenzophenone | " |
| 34 | zinc oxide particles (1) | " | " | " | " | X: oxygen atom<br>$R^1$: ethyl group<br>$R^2$: ethyl group | " | 2,3,4-trihydroxybenzophenone | " |
| 35 | zinc oxide particles (1) | without surface treatment | " | " | " | X: oxygen atom<br>$R^1$: ethyl group<br>$R^2$: ethyl group | " | 2,3,4-trihydroxybenzophenone | " |
| 36 | zinc oxide particles (1) | without surface treatment | " | " | " | X: oxygen atom<br>$R^1$: ethyl group<br>$R^2$: ethyl group | " | 2,3,4-trihydroxybenzophenone | " |
| 37 | zinc oxide particles (1) | without surface treatment | " | " | " | X: oxygen atom<br>$R^1$: ethyl group<br>$R^2$: ethyl group | " | 2,3,4-trihydroxybenzophenone | " |
| 38 | zinc oxide particles (1) | without surface treatment | " | " | " | X: oxygen atom<br>$R^1$: ethyl group<br>$R^2$: ethyl group | " | 2,3,4-trihydroxybenzophenone | " |
| 39 | zinc oxide particles (1) | without surface treatment | " | " | " | X: oxygen atom<br>$R^1$: ethyl group<br>$R^2$: ethyl group | " | 2,3,4-trihydroxybenzophenone | " |
| 40 | zinc oxide particles (1) | KBM602 | 52.5 | " | " | X: oxygen atom<br>$R^1$: ethyl group<br>$R^2$: ethyl group | " | 2,3,4-trihydroxybenzophenone | " |
| 41 | zinc oxide particles (1) | " | " | " | " | X: oxygen atom<br>$R^1$: ethyl group<br>$R^2$: ethyl group | " | 2,3,4-trihydroxybenzophenone | " |
| 42 | zinc oxide particles (1) | " | " | " | " | X: oxygen atom<br>$R^1$: ethyl group<br>$R^2$: ethyl group | " | 2,3,4-trihydroxybenzophenone | " |
| 43 | zinc oxide particles (1) | " | 105 | " | " | X: oxygen atom<br>$R^1$: ethyl group<br>$R^2$: ethyl group | " | 2,3,4-trihydroxybenzophenone | " |
| 44 | zinc oxide particles (1) | " | " | " | " | X: oxygen atom<br>$R^1$: ethyl group<br>$R^2$: ethyl group | " | 2,3,4-trihydroxybenzophenone | " |

TABLE 3-continued

| | Material for coating liquid for undercoat layer | | | | | | | | |
|---|---|---|---|---|---|---|---|---|---|
| | Zinc oxide particles | | | Polyol | | Blocked isocyanate compound whose isocyanate group is blocked with structure represented by formula (1) | | Others | |
| Example | Type | Type of surface treatment agent | Amount [part] | Type | Amount [part] | Group in formula (1) | Amount [part] | Type | Amount [part] |
| 45 | zinc oxide particles (1) | " | " | " | " | X: oxygen atom<br>$R^1$: ethyl group<br>$R^2$: ethyl group | " | 2,3,4-trihydroxybenzophenone | " |
| 46 | zinc oxide particles (1) | " | 42 | " | " | X: oxygen atom<br>$R^1$: ethyl group<br>$R^2$: ethyl group | " | 2,3,4-trihydroxybenzophenone | " |
| 47 | zinc oxide particles (1) | " | " | " | " | X: oxygen atom<br>$R^1$: ethyl group<br>$R^2$: ethyl group | " | 2,3,4-trihydroxybenzophenone | " |
| 48 | zinc oxide particles (1) | " | " | " | " | X: oxygen atom<br>$R^1$: ethyl group<br>$R^2$: ethyl group | " | 2,3,4-trihydroxybenzophenone | " |
| 49 | zinc oxide particles (1) | " | 115.5 | " | " | X: oxygen atom<br>$R^1$: ethyl group<br>$R^2$: ethyl group | " | 2,3,4-trihydroxybenzophenone | " |
| 50 | zinc oxide particles (1) | " | " | " | " | X: oxygen atom<br>$R^1$: ethyl group<br>$R^2$: ethyl group | " | 2,3,4-trihydroxybenzophenone | " |
| 51 | zinc oxide particles (1) | " | " | " | " | X: oxygen atom<br>$R^1$: ethyl group<br>$R^2$: ethyl group | " | 2,3,4-trihydroxybenzophenone | " |
| 52 | zinc oxide particles (1) | without surface treatment | 52.5 | " | " | X: oxygen atom<br>$R^1$: ethyl group<br>$R^2$: ethyl group | " | 2,3,4-trihydroxybenzophenone | " |
| 53 | zinc oxide particles (1) | without surface treatment | 105 | " | " | X: oxygen atom<br>$R^1$: ethyl group<br>$R^2$: ethyl group | " | 2,3,4-trihydroxybenzophenone | " |
| 54 | zinc oxide particles (1) | KBM603 | 81 | " | " | X: oxygen atom<br>$R^1$: ethyl group<br>$R^2$: ethyl group | " | 2,3,4-trihydroxybenzophenone | " |
| 55 | zinc oxide particles (1) | KBM602 | " | " | " | X: oxygen atom<br>$R^1$: ethyl group<br>$R^2$: ethyl group | " | 2,3,4-trihydroxybenzophenone | " |
| 56 | zinc oxide particles (1) | " | " | " | " | X: oxygen atom<br>$R^1$: ethyl group<br>$R^2$: ethyl group | " | 2,3,4-trihydroxybenzophenone | " |
| 57 | zinc oxide particles (1) | " | " | " | " | X: oxygen atom<br>$R^1$: ethyl group<br>$R^2$: ethyl group | " | 2,3,4-trihydroxybenzophenone | " |

TABLE 4

| | Material for coating liquid for undercoat layer Solvent mixture | | | | | | | | | |
|---|---|---|---|---|---|---|---|---|---|---|
| | Monohydric alcohol | | | | Ketone-based solvent/cyclic ether-based solvent | | | Other solvents | | |
| Example | Type | Amount [part] | Amount based on structure represented by formula (1) [chemical equivalent] | Amount based on solvent mixture [% by mass] | Type | Amount [part] | Amount based on solvent mixture [% by mass] | Type | Amount [part] | Amount based on solvent mixture [% by mass] |
| 30 | 1-propanol | 73.5 | 59.8 | 49 | cyclohexanone | 73.5 | 49 | naphtha, butyl acetate | 15 × 0.25 | 2 |
| 31 | 1-methoxy-2-propanol | 73.5 | 59.8 | 49 | tetrahydrofuran | 73.5 | 49 | naphtha, butyl acetate | 15 × 0.25 | 2 |
| 32 | cyclohexanol | 73.5 | 59.8 | 49 | 2-heptanone | 73.5 | 49 | naphtha, butyl acetate | 15 × 0.25 | 2 |
| 33 | methanol | 73.5 | 59.8 | 49 | methyl isobutyl ketone | 73.5 | 49 | naphtha, butyl acetate | 15 × 0.25 | 2 |
| 34 | benzyl alcohol | 73.5 | 59.8 | 49 | isophorone | 73.5 | 49 | naphtha, butyl acetate | 15 × 0.25 | 2 |
| 35 | 1-butanol | 73.5 | 59.8 | 49 | methyl ethyl ketone | 73.5 | 49 | naphtha, butyl acetate | 15 × 0.25 | 2 |

TABLE 4-continued

| | Material for coating liquid for undercoat layer Solvent mixture | | | | | | | | | |
|---|---|---|---|---|---|---|---|---|---|---|
| | Monohydric alcohol | | | | Ketone-based solvent/cyclic ether-based solvent | | | Other solvents | | |
| Example | Type | Amount [part] | Amount based on structure represented by formula (1) [chemical equivalent] | Amount based on solvent mixture [% by mass] | Type | Amount [part] | Amount based on solvent mixture [% by mass] | Type | Amount [part] | Amount based on solvent mixture [% by mass] |
| 36 | " | 15 | 12.2 | 10 | methyl ethyl ketone | 132 | 88 | naphtha, butyl acetate | 15 × 0.25 | 2 |
| 37 | " | 2 | 1.6 | 1 | methyl ethyl ketone | 159 | 97 | naphtha, butyl acetate | 15 × 0.25 | 2 |
| 38 | " | 132 | 107.3 | 88 | methyl ethyl ketone | 15 | 10 | naphtha, butyl acetate | 15 × 0.25 | 2 |
| 39 | " | 123 | 100.0 | 90 | methyl ethyl ketone | 10 | 7 | naphtha, butyl acetate | 15 × 0.25 | 3 |
| 40 | " | 73.5 | 59.8 | 49 | methyl ethyl ketone | 73.5 | 49 | naphtha, butyl acetate | 15 × 0.25 | 2 |
| 41 | " | 15 | 12.2 | 10 | methyl ethyl ketone | 132 | 88 | naphtha, butyl acetate | 15 × 0.25 | 2 |
| 42 | " | 132 | 107.3 | 88 | methyl ethyl ketone | 15 | 10 | naphtha, butyl acetate | 15 × 0.25 | 2 |
| 43 | " | 73.5 | 59.8 | 49 | methyl ethyl ketone | 73.5 | 49 | naphtha, butyl acetate | 15 × 0.25 | 2 |
| 44 | " | 15 | 12.2 | 10 | methyl ethyl ketone | 132 | 88 | naphtha, butyl acetate | 15 × 0.25 | 2 |
| 45 | " | 132 | 107.3 | 88 | methyl ethyl ketone | 15 | 10 | naphtha, butyl acetate | 15 × 0.25 | 2 |
| 46 | " | 73.5 | 59.8 | 49 | methyl ethyl ketone | 73.5 | 49 | naphtha, butyl acetate | 15 × 0.25 | 2 |
| 47 | " | 15 | 12.2 | 10 | methyl ethyl ketone | 132 | 88 | naphtha, butyl acetate | 15 × 0.25 | 2 |
| 48 | " | 132 | 107.3 | 88 | methyl ethyl ketone | 15 | 10 | naphtha, butyl acetate | 15 × 0.25 | 2 |
| 49 | " | 73.5 | 59.8 | 49 | methyl ethyl ketone | 73.5 | 49 | naphtha, butyl acetate | 15 × 0.25 | 2 |
| 50 | " | 15 | 12.2 | 10 | methyl ethyl ketone | 132 | 88 | naphtha, butyl acetate | 15 × 0.25 | 2 |
| 51 | " | 132 | 107.3 | 88 | methyl ethyl ketone | 15 | 10 | naphtha, butyl acetate | 15 × 0.25 | 2 |
| 52 | " | 73.5 | 59.8 | 49 | methyl ethyl ketone | 73.5 | 49 | naphtha, butyl acetate | 15 × 0.25 | 2 |
| 53 | " | 73.5 | 59.8 | 49 | methyl ethyl ketone | 73.5 | 49 | naphtha, butyl acetate | 15 × 0.25 | 2 |
| 54 | " | 73.5 | 59.8 | 49 | methyl ethyl ketone | 73.5 | 49 | naphtha, butyl acetate | 15 × 0.25 | 2 |
| 55 | " | 73.5 | 59.8 | 49 | methyl ethyl ketone | 73.5 | 49 | naphtha, butyl acetate | 15 × 0.25 | 2 |
| 56 | " | 73.5 | 59.8 | 49 | methyl ethyl ketone | 73.5 | 49 | naphtha, butyl acetate | 15 × 0.25 | 2 |
| 57 | " | 73.5 | 59.8 | 49 | methyl ethyl ketone | 73.5 | 49 | naphtha, butyl acetate | 15 × 0.25 | 2 |

TABLE 5

| | Material for coating liquid for undercoat layer | | | | | | | | |
|---|---|---|---|---|---|---|---|---|---|
| | Zinc oxide particles | | | Polyol | | Blocked isocyanate compound whose isocyanate group is blocked with structure represented by formula (1) | | Others | |
| Comparative Example | Type | Type of surface treatment agent | Amount [part] | Type | Amount [part] | Group in formula (1) | Amount [part] | Type | Amount [part] |
| 1 | zinc oxide particles (1) | KBM602 | 81 | butyral resin (BM-1) | 15 | X: oxygen atom $R^1$: ethyl group $R^2$: ethyl group | 15 × 0.75 | 2,3,4-trihydroxybenzophenone | 0.8 |
| 2 | zinc oxide particles (1) | " | " | butyral resin (BM-1) | " | X: oxygen atom $R^1$: ethyl group $R^2$: ethyl group | " | 2,3,4-trihydroxybenzophenone | " |

TABLE 5-continued

| | Material for coating liquid for undercoat layer | | | | | | | | |
|---|---|---|---|---|---|---|---|---|---|
| | Zinc oxide particles | | | Polyol | | Blocked isocyanate compound whose isocyanate group is blocked with structure represented by formula (1) | | Others | |
| Comparative Example | Type | Type of surface treatment agent | Amount [part] | Type | Amount [part] | Group in formula (1) | Amount [part] | Type | Amount [part] |
| 3 | zinc oxide particles (1) | " | " | butyral resin (BM-1) | " | X: oxygen atom $R^1$: ethyl group $R^2$: ethyl group | " | 2,3,4-trihydroxybenzophenone | " |
| 4 | zinc oxide particles (1) | " | " | butyral resin (BM-1) | " | X: oxygen atom $R^1$: ethyl group $R^2$: ethyl group | " | 2,3,4-trihydroxybenzophenone | " |
| 5 | zinc oxide particles (1) | " | " | butyral resin (BM-1) | " | X: oxygen atom $R^1$: ethyl group $R^2$: ethyl group | " | 2,3,4-trihydroxybenzophenone | " |
| 6 | zinc oxide particles (1) | " | " | butyral resin (BM-1) | " | X: oxygen atom $R^1$: ethyl group $R^2$: ethyl group | " | 2,3,4-trihydroxybenzophenone | " |
| 7 | zinc oxide particles (1) | " | " | butyral resin (BM-1) | " | X: oxygen atom $R^1$: ethyl group $R^2$: ethyl group | " | 2,3,4-trihydroxybenzophenone | " |
| 8 | zinc oxide particles (1) | " | " | butyral resin (BM-1) | " | X: oxygen atom $R^1$: ethyl group $R^2$: ethyl group | " | 2,3,4-trihydroxybenzophenone | " |
| 9 | zinc oxide particles (1) | " | " | butyral resin (BM-1) | " | X: single bond $R^1$: ethyl group $R^2$: methyl group | 15 × 0.598 | 2,3,4-trihydroxybenzophenone | " |
| 10 | zinc oxide particles (1) | " | " | butyral resin (BM-1) | " | X: oxygen atom $R^1$: ethyl group $R^2$: ethyl group | 15 × 0.75 | 2,3,4-trihydroxybenzophenone | " |
| 11 | zinc oxide particles (1) | " | " | butyral resin (BM-1) | " | X: oxygen atom $R^1$: ethyl group $R^2$: ethyl group | " | 2,3,4-trihydroxybenzophenone | " |
| 12 | zinc oxide particles (1) | " | " | butyral resin (BM-1) | " | X: oxygen atom $R^1$: ethyl group $R^2$: ethyl group | " | 2,3,4-trihydroxybenzophenone | " |
| 13 | zinc oxide particles (1) | " | " | butyral resin (BM-1) | " | X: oxygen atom $R^1$: ethyl group $R^2$: ethyl group | " | 2,3,4-trihydroxybenzophenone | " |
| 14 | zinc oxide particles (1) | without surface treatment | " | butyral resin (BM-1) | " | X: oxygen atom $R^1$: ethyl group $R^2$: ethyl group | " | 2,3,4-trihydroxybenzophenone | " |
| 15 | zinc oxide particles (1) | without surface treatment | " | butyral resin (BM-1) | " | X: oxygen atom $R^1$: ethyl group $R^2$: ethyl group | " | 2,3,4-trihydroxybenzophenone | " |
| 16 | zinc oxide particles (1) | KBM602 | " | butyral resin (BM-1) | " | X: oxygen atom $R^1$: ethyl group $R^2$: ethyl group | " | 2,3,4-trihydroxybenzophenone | " |
| 17 | zinc oxide particles (1) | " | " | butyral resin (BM-1) | " | X: oxygen atom $R^1$: ethyl group $R^2$: ethyl group | " | 2,3,4-trihydroxybenzophenone | " |
| 18 | zinc oxide particles (1) | " | " | butyral resin (BM-1) | " | X: oxygen atom $R^1$: ethyl group $R^2$: ethyl group | " | 2,3,4-trihydroxybenzophenone | " |
| 19 | zinc oxide particles (1) | " | " | butyral resin (BM-1) | " | X: oxygen atom $R^1$: ethyl group $R^2$: ethyl group | " | 2,3,4-trihydroxybenzophenone | " |

TABLE 6

| | Material for coating liquid for undercoat layer Solvent mixture | | | | | | | | | |
|---|---|---|---|---|---|---|---|---|---|---|
| | Monohydric alcohol | | | | Monohydric alcohol | | | Monohydric alcohol | | |
| Comparative Example | Type | Amount [part] | Amount based on structure represented by formula (1) [chemical equivalent] | Amount based on solvent mixture [% by mass] | Type | Amount [part] | Amount based on solvent mixture [% by mass] | Type | Amount [part] | Amount based on solvent mixture [% by mass] |
| 1 | 1-butanol | 73.5 | 59.8 | 95 | — | 0 | 0 | naphtha, butyl acetate | 15 × 0.25 | 5 |

TABLE 6-continued

| | Material for coating liquid for undercoat layer Solvent mixture | | | | | | | | | |
|---|---|---|---|---|---|---|---|---|---|---|
| | Monohydric alcohol | | | | Monohydric alcohol | | | Monohydric alcohol | | |
| Comparative Example | Type | Amount [part] | Amount based on structure represented by formula (1) [chemical equivalent] | Amount based on solvent mixture [% by mass] | Type | Amount [part] | Amount based on solvent mixture [% by mass] | Type | Amount [part] | Amount based on solvent mixture [% by mass] |
| 2 | — | 0 | 0 | 0 | methyl ethyl ketone | 73.5 | 95 | naphtha, butyl acetate | 15 × 0.25 | 5 |
| 3 | 1-butanol | 73.5 | 59.8 | 49 | o-xylene | 73.5 | 49 | naphtha, butyl acetate | 15 × 0.25 | 2 |
| 4 | o-xylene | 73.5 | 59.8 | 49 | methyl ethyl ketone | 73.5 | 49 | naphtha, butyl acetate | 15 × 0.25 | 2 |
| 5 | ethylene glycol | 73.5 | 59.8 | 49 | methyl ethyl ketone | 73.5 | 49 | naphtha, butyl acetate | 15 × 0.25 | 2 |
| 6 | 1-butanol | 73.5 | 59.8 | 49 | diethyl ether | 73.5 | 49 | naphtha, butyl acetate | 15 × 0.25 | 2 |
| 7 | " | 1 | 0.8 | 1 | methyl ethyl ketone | 146 | 97 | naphtha, butyl acetate | 15 × 0.25 | 2 |
| 8 | " | 140 | 113.8 | 92 | methyl ethyl ketone | 9 | 6 | naphtha, butyl acetate | 15 × 0.25 | 2 |
| 9 | 1-butanol | 140 + 15 × 0.247 | 119 | 93 | methyl ethyl ketone | 8 | 5 | n-butyl acetate | 15 × 0.155 | 2 |
| 10 | ethanol | 1 | 0.8 | 1 | acetone | 146 | 97 | naphtha, butyl acetate | 15 × 0.25 | 2 |
| 11 | " | 140 | 113.8 | 92 | " | 9 | 6 | naphtha, butyl acetate | 15 × 0.25 | 2 |
| 12 | 1-propanol | 1 | 0.8 | 1 | cyclohexanone | 146 | 97 | naphtha, butyl acetate | 15 × 0.25 | 2 |
| 13 | 1-propanol | 140 | 113.8 | 92 | " | 9 | 6 | naphtha, butyl acetate | 15 × 0.25 | 2 |
| 14 | 1-butanol | 1 | 0.8 | 1 | methyl ethyl ketone | 146 | 97 | naphtha, butyl acetate | 15 × 0.25 | 2 |
| 15 | " | 140 | 113.8 | 92 | methyl ethyl ketone | 9 | 6 | naphtha, butyl acetate | 15 × 0.25 | 2 |
| 16 | " | 1 | 0.8 | 1 | methyl ethyl ketone | 146 | 97 | naphtha, butyl acetate | 15 × 0.25 | 2 |
| 17 | " | 140 | 113.8 | 92 | methyl ethyl ketone | 9 | 6 | naphtha, butyl acetate | 15 × 0.25 | 2 |
| 18 | " | 1 | 0.8 | 1 | methyl ethyl ketone | 146 | 97 | naphtha, butyl acetate | 15 × 0.25 | 2 |
| 19 | " | 140 | 113.8 | 92 | methyl ethyl ketone | 9 | 6 | naphtha, butyl acetate | 15 × 0.25 | 2 |

TABLE 7

| Example | Number-average particle diameter of zinc oxide particles in coating liquid for undercoat layer [nm] | | Viscosity of coating liquid for undercoat layer [mPa · s] | | Evaluation of black spot in solid white image | |
|---|---|---|---|---|---|---|
| | 1 day later | 1 month later | 1 day later | 1 month later | | |
| 1 | 220 | 225 | 250 | 261 | A | 0 |
| 2 | 230 | 232 | 261 | 260 | A | 0 |
| 3 | 231 | 233 | 255 | 261 | A | 0 |
| 4 | 242 | 271 | 268 | 291 | B | 3 |
| 5 | 234 | 248 | 240 | 259 | A | 0 |
| 6 | 268 | 274 | 234 | 245 | B | 1 |
| 7 | 324 | 337 | 240 | 240 | C | 4 |
| 8 | 220 | 234 | 263 | 254 | A | 0 |
| 9 | 230 | 221 | 234 | 245 | A | 0 |
| 10 | 234 | 254 | 264 | 283 | B | 3 |
| 11 | 272 | 289 | 243 | 252 | B | 2 |
| 12 | 340 | 339 | 270 | 278 | C | 4 |
| 13 | 230 | 234 | 231 | 248 | A | 0 |
| 14 | 231 | 248 | 248 | 245 | A | 0 |
| 15 | 242 | 256 | 221 | 231 | A | 0 |
| 16 | 213 | 210 | 231 | 233 | A | 0 |
| 17 | 261 | 254 | 248 | 243 | A | 0 |
| 18 | 216 | 223 | 252 | 253 | A | 0 |
| 19 | 227 | 219 | 266 | 260 | A | 0 |
| 20 | 245 | 246 | 287 | 302 | B | 3 |
| 21 | 287 | 303 | 262 | 275 | B | 2 |
| 22 | 309 | 322 | 286 | 301 | C | 4 |
| 23 | 221 | 227 | 252 | 259 | A | 0 |
| 24 | 226 | 246 | 268 | 249 | A | 0 |
| 25 | 245 | 246 | 279 | 289 | A | 0 |
| 26 | 247 | 248 | 278 | 289 | A | 0 |
| 27 | 248 | 252 | 278 | 312 | B | 2 |
| 28 | 282 | 270 | 263 | 256 | B | 1 |
| 29 | 336 | 328 | 263 | 285 | C | 4 |

TABLE 8

| Example | Number-average particle diameter of zinc oxide particles in coating liquid for undercoat layer [nm] | | Viscosity of coating liquid for undercoat layer [mPa · s] | | Evaluation of black spot in solid white image | |
|---|---|---|---|---|---|---|
| | 1 day later | 1 month later | 1 day later | 1 month later | | |
| 30 | 254 | 246 | 255 | 256 | A | 0 |
| 31 | 250 | 248 | 260 | 254 | A | 0 |
| 32 | 246 | 278 | 289 | 290 | A | 0 |
| 33 | 236 | 228 | 264 | 274 | A | 0 |
| 34 | 236 | 228 | 264 | 274 | A | 0 |
| 35 | 265 | 261 | 248 | 246 | A | 0 |
| 36 | 264 | 268 | 234 | 242 | A | 0 |
| 37 | 276 | 284 | 264 | 286 | B | 1 |
| 38 | 288 | 282 | 234 | 225 | B | 1 |
| 39 | 324 | 330 | 226 | 248 | C | 4 |
| 40 | 210 | 209 | 221 | 225 | A | 0 |
| 41 | 221 | 211 | 231 | 223 | A | 0 |
| 42 | 215 | 220 | 224 | 235 | A | 0 |
| 43 | 234 | 236 | 253 | 264 | A | 0 |
| 44 | 235 | 238 | 272 | 278 | A | 0 |
| 45 | 237 | 235 | 284 | 286 | A | 0 |
| 46 | 202 | 205 | 231 | 235 | C | 4 |
| 47 | 201 | 211 | 245 | 254 | C | 4 |
| 48 | 203 | 220 | 251 | 272 | C | 4 |
| 49 | 364 | 375 | 313 | 322 | C | 4 |
| 50 | 383 | 391 | 345 | 368 | C | 4 |
| 51 | 373 | 383 | 327 | 356 | C | 4 |
| 52 | 231 | 242 | 221 | 231 | A | 0 |
| 53 | 251 | 266 | 282 | 274 | A | 0 |
| 54 | 234 | 232 | 260 | 262 | A | 0 |
| 55 | 220 | 225 | 250 | 261 | B | 2 |

TABLE 8-continued

| Example | Number-average particle diameter of zinc oxide particles in coating liquid for undercoat layer [nm] | | Viscosity of coating liquid for undercoat layer [mPa · s] | | Evaluation of black spot in solid white image | |
|---|---|---|---|---|---|---|
| | 1 day later | 1 month later | 1 day later | 1 month later | | |
| 56 | 220 | 225 | 250 | 261 | A | 0 |
| 57 | 220 | 225 | 250 | 261 | C | 4 |

TABLE 9

| Comparative Example | Number-average particle diameter of zinc oxide particles in coating liquid for undercoat layer [nm] | | Viscosity of coating liquid for undercoat layer [mPa · s] | | Evaluation of black spot in solid white image | |
|---|---|---|---|---|---|---|
| | 1 day later | 1 month later | 1 day later | 1 month later | | |
| 1 | 472 | 491 | 324 | 341 | E | 6 |
| 2 | 402 | 692 | 483 | 870 | D | 5 |
| 3 | 503 | 616 | 312 | 354 | E | 8 |
| 4 | 424 | 762 | 502 | 933 | E | 16 |
| 5 | 384 | 502 | 481 | 792 | D | 5 |
| 6 | 602 | 643 | 324 | 361 | E | 7 |
| 7 | 331 | 496 | 490 | 883 | E | 13 |
| 8 | 761 | 689 | 412 | 434 | E | 10 |
| 9 | 573 | 612 | 369 | 402 | E | 9 |
| 10 | 339 | 371 | 453 | 738 | E | 16 |
| 11 | 661 | 692 | 314 | 373 | E | 8 |
| 12 | 764 | 667 | 620 | 1080 | E | 28 |
| 13 | 777 | 893 | 324 | 370 | E | 8 |
| 14 | 388 | 612 | 612 | 964 | E | 24 |
| 15 | 715 | 903 | 361 | 360 | E | 13 |
| 16 | 411 | 791 | 587 | 928 | E | 19 |
| 17 | 752 | 833 | 324 | 333 | E | 10 |
| 18 | 402 | 702 | 559 | 877 | E | 20 |
| 19 | 732 | 889 | 312 | 334 | E | 10 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-011763 filed Jan. 25, 2013 and No. 2013-255198 filed Dec. 10, 2013, which are hereby incorporated by reference herein in their entirety.

What is claimed is:

1. A method for producing an electrophotographic photosensitive member comprising a support, an undercoat layer formed on the support, and a photosensitive layer formed on the undercoat layer, the method comprising:

preparing a coating liquid for an undercoat layer containing:

zinc oxide particles;

a polyol;

a blocked isocyanate compound whose isocyanate group is blocked with a structure represented by the following formula (1); and a solvent mixture;

forming a coat of the coating liquid for an undercoat layer, and drying and curing the coat to form the undercoat layer, (1)

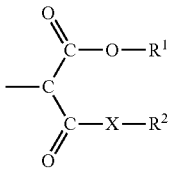

wherein, in the formula (1)

X represents a single bond or an oxygen atom, $R^1$ and $R^2$ each independently represent an alkyl group having 1 to 4 carbon atoms, and wherein the solvent mixture comprises:

a monohydric alcohol in an amount of 1 chemical equivalent or more based on the structure represented by the formula (1), and 90% by mass or less based on the total mass of the solvent mixture; and a ketonic solvent and/or a cyclic ether solvent in an amount of 7% by mass or more based on the total mass of the solvent mixture.

2. The method for producing an electrophotographic photosensitive member according to claim 1, wherein the solvent mixture contains the monohydric alcohol in an amount of 50% by mass or less based on the total mass of the solvent mixture.

3. The method for producing an electrophotographic photosensitive member according to claim 1, wherein the blocked isocyanate compound has a central skeleton composed of isocyanurate.

4. The method for producing an electrophotographic photosensitive member according to claim 1, wherein the coat is dried at a drying temperature of 130° C. or higher and 155° C. or lower.

5. The method for producing an electrophotographic photosensitive member according to claim 1, wherein the ratio (Mm/Mu) of the mass (Mm) of the zinc oxide particles to the total mass (Mu) of the blocked isocyanate compound and the polyol is 2/1 or more and 4/1 or less (mass ratio).

6. The method for producing an electrophotographic photosensitive member according to claim 1, wherein the monohydric alcohol is at least one selected from the group consisting of ethanol, propanol, butanol, methoxypropanol, and cyclohexanol.

7. The method for producing an electrophotographic photosensitive member according to claim 1, wherein the ketonic solvent is at least one selected from the group consisting of acetone, methyl ethyl ketone, and cyclohexanone.

8. The method for producing an electrophotographic photosensitive member according to claim 1, wherein the cyclic ether solvent is tetrahydrofuran.

9. The method for producing an electrophotographic photosensitive member according to claim 1, wherein each of $R^1$ and $R^2$ in the formula (1) represents an ethyl group.

10. The method for producing an electrophotographic photosensitive member according to claim 1, wherein the zinc oxide particles are surface-treated with a silane coupling agent.

* * * * *